United States Patent [19]

Jugle et al.

[11] Patent Number: 4,989,047

[45] Date of Patent: Jan. 29, 1991

[54] CLEANING APPARATUS FOR THE REDUCTION OF AGGLOMERATION-CAUSED SPOTTING

[75] Inventors: Don B. Jugle, Penfield; Nero R. Lindblad, Ontario; Robert S. Pozniakas, Rochester, all of N.Y.

[73] Assignee: Xerox Corporation, Stamford, Conn.

[21] Appl. No.: 449,682

[22] Filed: Dec. 11, 1989

[51] Int. Cl.[5] ..... G03G 21/00

[52] U.S. Cl. ..... 355/297; 355/299; 118/652; 15/256.5

[58] Field of Search ..... 355/296, 297, 299; 118/652; 15/256.51, 256.5

[56] References Cited

U.S. PATENT DOCUMENTS

| | | | |
|---|---|---|---|
| 3,572,923 | 3/1971 | Fisher et al. | 355/15 |
| 3,580,673 | 5/1971 | Yang | 355/15 |
| 3,655,373 | 4/1972 | Fisher et al. | 96/1.4 |
| 3,722,018 | 3/1973 | Fisher | 15/1.5 |
| 3,741,643 | 6/1973 | Smith et al. | 355/10 |
| 3,780,391 | 12/1973 | Leenhouts | 15/1.5 |
| 3,918,808 | 11/1975 | Narita | 355/15 |
| 3,947,108 | 3/1976 | Thettu et al. | 355/15 |
| 4,026,648 | 5/1977 | Takahashi | 355/15 |
| 4,089,683 | 5/1978 | Knieser | 96/1 LY |
| 4,116,555 | 9/1978 | Young et al. | 355/15 |
| 4,185,399 | 1/1980 | Gladish | 34/120 |
| 4,279,501 | 7/1981 | Kojima et al. | 355/15 |
| 4,364,660 | 12/1982 | Oda | 355/15 |
| 4,373,800 | 2/1983 | Kamiyama et al. | 355/10 |
| 4,494,863 | 1/1985 | Laing | 355/15 |
| 4,561,766 | 12/1985 | Fox | 355/15 |
| 4,639,124 | 1/1987 | Nye, Jr. et al. | 355/15 |
| 4,819,026 | 4/1989 | Lange et al. | 355/15 |

FOREIGN PATENT DOCUMENTS 0036290 12/1984 European Pat. Off. .

OTHER PUBLICATIONS

IBM Technical Disclosure Bulletin; "Air Wedge and Air Entry", K. Sanders, vol. 19, No. 8, Jan. 1977, p. 3215.

*Primary Examiner*—Joan H. Pendergrass
*Attorney, Agent, or Firm*—Mark Costello

[57] ABSTRACT

In association with a primary cleaner device, used to remove the preponderance of toner remaining on a charge retentive surface after transfer, a secondary cleaning member is provided, arranged for the removal of toner agglomerates formed by the agglomeration of toner, and toner and debris. The secondary cleaning member is characterized as a thin scraper member arranged at a low angle of attack with respect to the photoreceptor so that a maximum shearing force can be applied by the blade to the agglomerates for removal thereof. A relatively low load is applied to the blade, so that the problems associated with normal cleaning engagement of blades with a charge retentive surface are avoided.

30 Claims, 5 Drawing Sheets

CLEANING APPARATUS FOR THE REDUCTION OF AGGLOMERATION-CAUSED SPOTTING

This invention relates to reproduction apparatus and more particularly to cleaning apparatus for removing residual toner and debris from a charge retentive surface including a secondary cleaning system for release and removal of agglomerates from the surface that are not cleaned therefrom at the primary cleaner.

INCORPORATION BY REFERENCE

The following are herein incorporated by reference for the purpose of background information on brush cleaning systems: EP 036290-B1, U.S. Pat. No. 4,494,863 to Laing; U.S. Pat. No. 4,639,124 to Nye; U.S. Pat. No. 3,572,923 to Fisher; U.S. Pat. No. 3,655,373 to Fisher et al.; U.S. Pat. No. 3,780,391 to Leenhouts; U.S. Pat. No. 3,580,673 to Yang; U.S. Pat. No. 3,722,018 to Fisher; U.S. Pat. No. 4,116,555 to Young et al. and U.S. Pat. No. 4,819,026 to Lange et al.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways. Ion projection devices where a charge is imagewise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed in automatic xerographic devices utilizes a brush with soft conductive fiber bristles which have suitable triboelectric characteristics. While the bristles are soft they are sufficiently firm to remove residual toner particles from the charge retentive surface. A voltage is applied to the fibers to enhance removal of toner from the charge retentive surface.

Not all toner and debris is removed from the surface by the brush cleaner. For reasons that are unclear, toner particles agglomerate with themselves and with certain types of debris to form a spot-wise deposition that can eventually strongly adhere to the charge retentive surface. These spots range from 50 μm to greater than 400 μm in diameter and 5-25 μm in thickness, but typically are about 200 μm in diameter and 5-15 μm in thickness. The agglomerates range in material compositions from nothing but toner to a broad assortment of plastics and debris from paper. The spots cause a copy quality defect showing up as a black spot on a background area of the copy which is the same size as the spot on the photoreceptor. The spot on the copy varies slightly with the exact machine operating conditions, but cannot be deleted by control of the the machine process characteristics.

While attempts were made to eliminate the agglomerate spotting by controlling of extraneous debris within the device, this solution has been found difficult if not impossible to implement. Additionally, there was no way to eliminate the formation of agglomerates that the toner formed itself. However, in studying the formation of these spots, it was noted that the spots appeared instantaneously on the charge retentive surface, i.e., the spots were not the result of a continuing nucleation process. It was subsequently noted that newly deposited spots were more weakly adhered to the surface than older spots.

The combination in a cleaning system of a brush cleaner with a cleaning blade in residual toner removing, sealing engagement is known. U.S. Pat. No. 4,364,660 to Oda shows a fur brush in combination with a soft rubber cleaning blade, where the cleaning blade functions as the primary means for toner release from the photoreceptor, and the brush operates to remove toner accumulating at the blade to the toner collection system. U.S. Pat. No. 3,947,108 to Thettu et al, shows a brush and blade combination with the brush acts as a scrubber member for the release of accumulating toner film while the blade is the primary cleaner. In a two cycle system, where the photoreceptor rotates twice for every copying operation, U.S. Pat. No. 3,918,808 to Narita shows the use of a cleaning blade as a primary cleaner, in typical cleaning engagement adjacent a magnetic brush used for both development and cleaning. U.S. Pat. No. 4,279,501 to Kojima et al. shows a cleaning system with a cleaning roller and cleaning blade. U.S. Pat. No. 4,561,766 to Fox and U.S. Pat. No. 4,026,648 to Takahashi show various blade cleaner systems. U.S. Pat. No. 4,373,800 To Kamiyama et al., and U.S. Pat. No. 4,089,683 to Knieser show liquid developer cleaning arrangements, including, respectively, a blade and squeegee roller, and a blade and foam belt. U.S. Pat. No. 4,185,399 to Gladish and U.S. Pat. No. 4,741,643 to Smith et al. each show air stream devices for cleaning liquids from a surface. IBM Technical Disclosure Bulletin, Vol. 19, No. 8, p. 3215, (January, 1977) by K. Sanders, notes the use of an air stream for the removal of toner from a cleaning brush used to clean an electrophotographic drum. These references are all incorporated by reference herein.

SUMMARY OF THE INVENTION

In accordance with the invention in an electrophotographic device there is provided an improved cleaning system including a primary cleaner for removal of the preponderance of toner remaining on the charge retentive surface after transfer and a further cleaning arrangement for the "chipping" or shearing removal of spot causing toner agglomerates.

In accordance with one aspect of the invention, in association with a primary cleaner device, used to remove the preponderance of toner remaining on a charge retentive surface after transfer, a secondary cleaning member is provided, arranged for the removal of toner agglomerates formed by the agglomeration of toner, and toner and debris. The secondary cleaning member is characterized as a blade member arranged in doctor or chiseling mode configuration, at a low angle of attack with respect to the photoreceptor so that a maximum shearing force can be applied by the blade to the agglomerates for removal thereof. A relatively low load is applied to the blade, so that the problems associated with normal cleaning engagement of blades with a charge retentive surface are avoided. Because of the low load of the blade, the minimal amount of toner that normally passes through any cleaning system serves as lubricant for the blade without the need for further added lubricant.

In accordance with another aspect of the invention, in a brush cleaner housing, supporting a cleaning brush in primary cleaning engagement with a charge retentive surface, for releasing and removing toner from the charge retentive surface, and an air detoning arrangement for the brush, an agglomerate cleaning blade member is supported downstream from the cleaning brush at a low angle of attack with respect to the photoreceptor and with a relatively low load applied, and arranged with a cleaning tip thereof sufficiently close to the cleaning brush so that accumulations of agglomerates released from the charge retentive surface by the blade are removed from the charge retentive surface by the cleaning brush. Because the blade tends to seal the downstream side of the cleaner housing, and air flow is required for operation of the brush cleaner, the housing is provided with an opening or openings to allow air flow therethrough.

These and other aspects of the invention will become apparent from the following description used to illustrate a preferred embodiment of the invention read in conjunction with the accompanying drawings in which.

Figure 1:
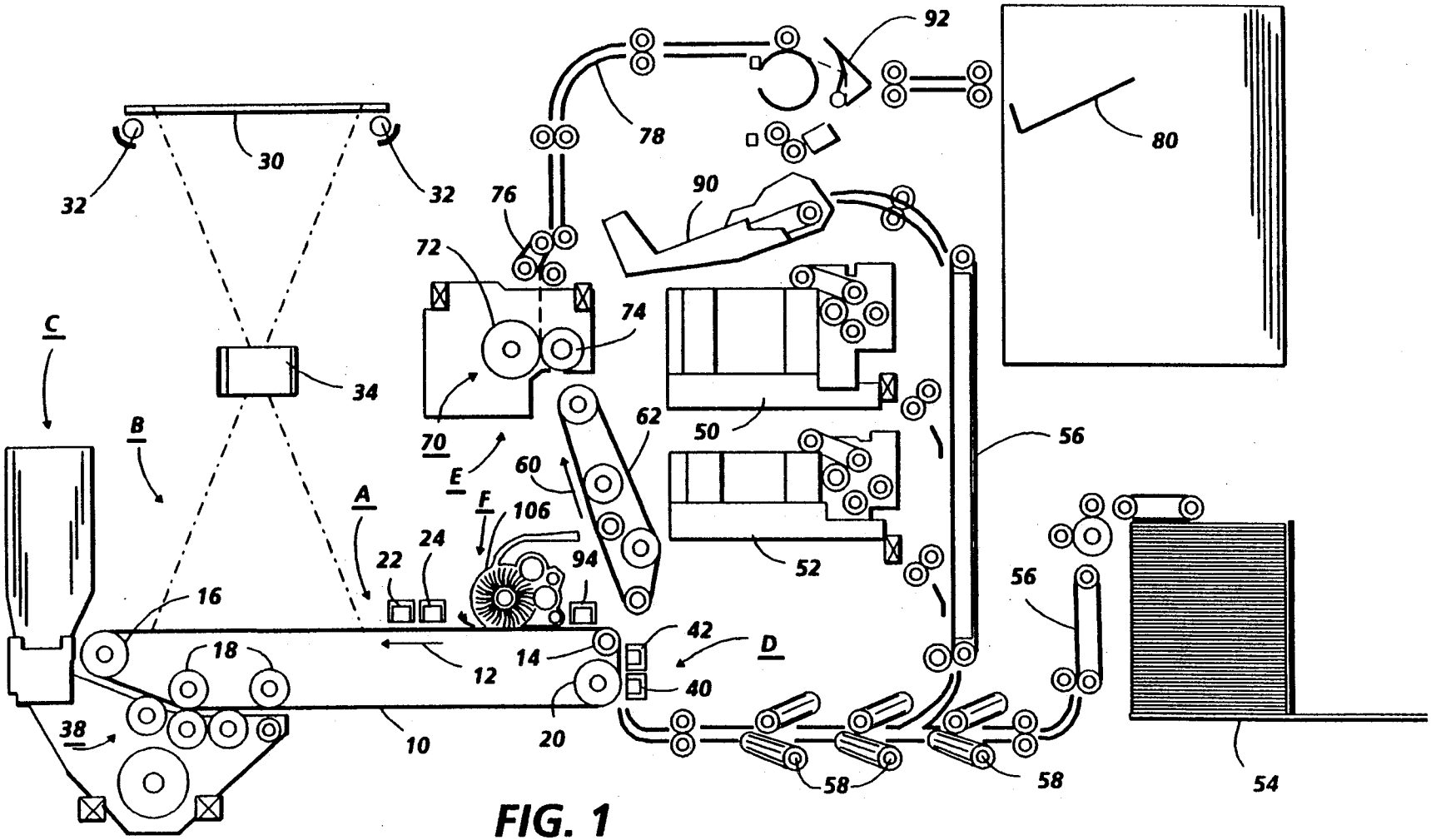
FIG. 1 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original.

A reproduction machine in which the present invention finds advantageous use utilizes photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as a paper copy sheet is moved into contact with the developed latent images on belt 10. First, the latent image on belt 10 is exposed to a pretransfer light from a lamp (not shown) to reduce the attraction between photoreceptor belt 10 and the toner powder image thereon. Next, corona generating device 40 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

A pre-clean corona generating device 94 is provided for exposing the residual toner and contaminants (hereinafter, collectively referred to as toner) to positive charges to thereby narrow the charge distribution thereon for more effective removal at cleaning station F, more completely described hereinafter. It is contemplated that residual toner remaining on photoreceptor belt 10 after transfer will be reclaimed and returned to the developer station C by any of several well known reclaim arrangements, and in accordance with arrangement described below, although selection of a non-reclaim option is possible.

As thus described, a reproduction machine in accordance with the present invention may be any of several well known devices. Variations may be expected in specific processing, paper handling and control arrangements without affecting the present invention.

Figures 2A, 2B:
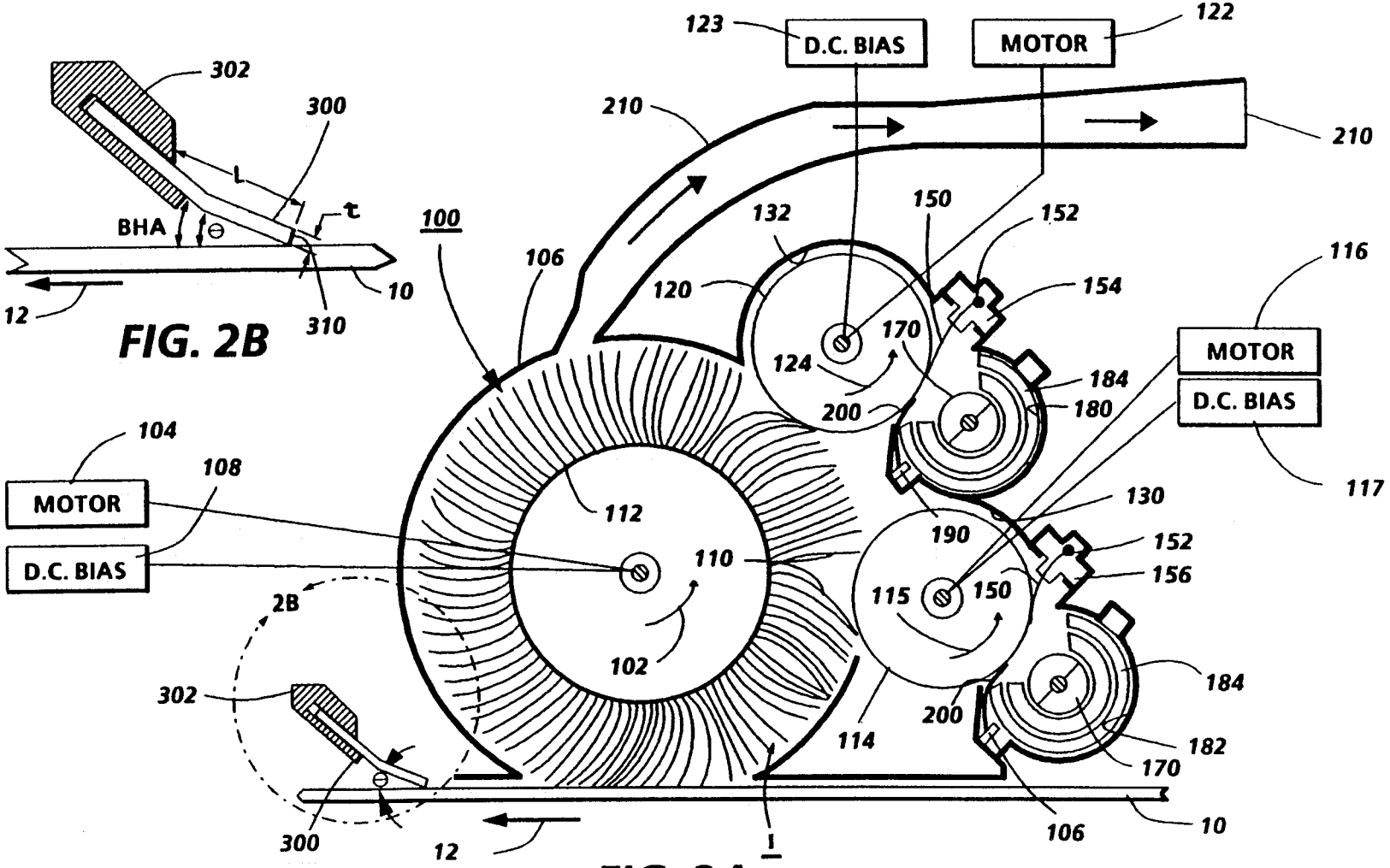
FIG. 2A is a schematic illustration of an agglomerate cleaner incorporated in the cleaner of the machine of FIG. 1.
FIG. 2B shows another embodiment of a cleaner incorporating the invention.

In accordance with the invention, and with reference to FIG. 2A, cleaning station F includes a fiber brush cleaning arrangement having dual detoning rolls is provided for the removal of residual toner and debris from belt 10. A captive fiber cleaning brush 100 is supported for rotational movement in the direction of the arrow 102 via motor 104, within a cleaning housing 106, and negatively biased by means of a D. C. power source 108. As described in U.S. Pat. No. 3,572,923 to Fisher et al, a fiber brush may advantageously comprise a large number of conductive cleaning fibers 110 supported on a cylindrical conductive member 112. Residual toner and contaminants or debris such as paper fibers and Kaolin are removed from the photoreceptor belt 10 surface by means of a brushing action of the fibers 110 against belt 10 and the electrostatic charge applied to the fibers from by the D. C. power supply 108. In a xerographic system of the type disclosed herein, brush 100 will remove both toner and debris from the photoreceptor, the former having a positive and the latter typically having a negative charge. Negatively charged contaminants are removed along with the positively charged toner particles to which they may be adhered. Brush fibers 110 bearing toner and debris removed from belt 10 are first contacted by a first detoning roll 114 supported for rotation in the direction of arrow 115, the same direction as brush 100 by means of a motor 116. An electrical bias is supplied to first detoning roll 114 from D. C. power supply 117. The position of detoning roll 114 is selected so that the brush fibers 110 are contacted by the detoning roll closely adjacent to the first oscillation node I after contact with the photoreceptor is ended. It is additionally desirable that this position also be located closely adjacent to the photoreceptor, so that a minimum amount of time is allowed for charge triboelectric charge exchange between the toner and debris and the brush fibers. In this manner, the bias level on the detoning rolls may be selected to obtain optimum attraction of debris. A second detoning roll 120 is provided for further removal of the preponderance of residual toner from the brush at a location spaced along the circumference of the brush. A motor 122 drives the roll in the direction of the arrow 124, the same direction as fiber brush 100 and roll 114. An electrical bias is supplied to the roll 120 from a source of D. C. power 123. In a working embodiment of the described cleaning arrangement, the cleaning brush is biased to a potential of about −250 V, while the first detoning roll is biased to about −50 V and the second detoning roll is biased to about −650 V. Thus, only the lightly charged debris and wrong sign toner will be removed from the brush at the first detoning roll, while the preponderance of toner will be removed from the second roll for recirculation. Other brush cleaning structure have applicability to the present invention, and may comprise insulative fibers.

Recesses 130 and 132 in cleaning housing 106 are provided for the support of the detoning rolls 114 and 120 respectively therein. Within these recesses, and removed from cleaning brush 100, are located blade and auger arrangements for the chiseling removal of toner from the detoning rolls and movement of the toner to a storage area or to the developing station. Accordingly, each detoning roll is provided with an associated cleaning blade 150 supported in chiseling contact with each detoning roll in a molded blade holder 152, which is slidably insertable into integrally formed, complementary blade holder recesses 154 and 156 in housing 106. The integral arrangement of blade 150 and blade holder 152 allows for simple removal from blade holder recesses 154 and 156, and replacement without concern for replacement of spring loaded mounting apparatus.

Debris and toner from detoning rolls 114 and 120 are removed from the cleaning housing 106 by an auger arrangement, which respectively moves debris to a storage area for subsequent removal and toner to the developer station for reuse. Accordingly, augers 170 are supported for rotating movement within auger recesses 180 and 182, formed in the cleaning housing adjacent to recesses 130 and 132 for the detoning rolls. The augers are supported within the cleaning housing within liners 184 formed in plastic to fit into the auger recesses, and which are slidably removable from the tubes for cleaning and service. Film seal member 200 extends towards the blade 150, into contact with the detoning rolls, so that toner or debris chiseled from the detoning roll with the blade is maintained in the area adjacent the blade and auger arrangement, and does not enter the area between the plastic liner and the auger recess. With blade 150, film seal 200 effectively seals the auger arrangement from the remainder of the cleaning station and prevents toner clouds created by the blade and auger from dispersing outside of the auger/blade cavity.

In addition to electrostatic removal of toner and debris by detoning rolls 114 and 120 from brush 100, a cleaner may be provided with mechanical removal of toner from brush 100 and cleaner housing 106 by the application of an air stream and vacuum collection arrangement. A vacuum source (not shown) creates a flow of air through manifold 210, which is connected via opening 212 to the interior of housing 106. Air flow through housing 106, particularly from the opening of the housing adjacent the photoreceptor 10, entrains and carries toner and debris through the housing and manifold 210 to an output or storage area. The invention also has applicability to a magnetic brush cleaner, where the fibers are comprised of carrier material.

In accordance with one embodiment of the invention, as shown in FIG. 2A, an agglomerate cleaning blade for the removal of spot causing agglomerates from the photoreceptor, adhering thereto after cleaning, is located in a cleaning position slightly downstream (in the process direction) from the cleaning brush, generally adjacent and parallel to photoreceptor 10 and transverse to the process direction 12. An agglomerate cleaning blade 300 may be a thin polyurethane blade, generally about 1 mm in thickness, a durometer of 70 Shore A. Of course, other blade materials, including hard plastics and metals, with different durometers, or greater blade thickness, may work if the blade tip can be maintained at the same angle of attack and load, as will be described below. Blade 300 is supported in a slotted blade holder 302 adapted to retain the blade in cleaning position. Blade holder 302 is mounted on a blade carrier to the machine frame (not shown). Blade holder 302 supports blade 300 to provide a very low angle of attack with respect to the photoreceptor. The angle of attack Θ (the angle at the tip 310 of blade 300) is typically in the range of just greater than 0° to approximately 9° with respect to the photoreceptor. The term "just greater than 0°", should be understood as defining an angle of attack that produces an effect distinguished from that which occurs when the blade is parallel (0°) to the photoreceptor. Additionally, the load on the blade is selected to be relatively low, in the range of 0 to 10 gm/cm, and preferably within the range of approximately 5–8 gm/cm. Minor variations from these ranges may be acceptable, if the functional aspects of the agglomerate cleaning arrangement are retained.

In the described embodiment, blade holder 302 may pivot in a plane parallel to photoreceptor 12, about an axis perpendicular to the photoreceptor, so long as blade 300 is held at the critical angle.

The load on blade 300 and angle of attack Θ are selected to avoid the problems typically associated with the frictional sealing relationship of a cleaning blade with the photoreceptor in the usual blade cleaning relationship, while obtaining agglomerate particle removal. The force that is desirably applied to agglomerates adhering to the photoreceptor 10 by blade 300 is directed approximately parallel to the surface of photoreceptor 10, to create a shearing or chipping force. If the agglomerate adheres to the surface too tenaciously for removal by blade 300, the blade will not exhibit the problem of catastrophic tucking failure. The range of blade loads and attack angles Θ given above, and their equivalents, allow this characteristic, which would be otherwise undesirable in a blade cleaner. It will be appreciated that without the frictional sealing engagement normally used in blade cleaning apparatus, the agglomerate cleaning blade is substantially non-functional for cleaning residual toner.

With reference to FIG. 2B, the angle at blade tip 310 of blade 300 depends on the thickness t of the blade T, the free extension of the blade L, the blade holder angle BHA and the durometer of the material used for the blade. Thus, for t=1 mm, BHA=45°, and L=12 mm, attack angle Θ is about 5° at a load of about 10 gm/cm. In a second case, for t=1 mm, BHA=30°, and L=12 mm, attack angle Θ is about 5° at a load of about 5 gm/cm. In a third case, for t=3.2 mm, BHA=10°, and L=12 mm, attack angle Θ is as about 7° at a load of about 7 gm/cm. A thinner blade with a greater durometer value may be desirable, when the blade is closely associated with the cleaner brush. Thicker blades however avoid the problem of blade set, and foldover problems associated with thin blades in the range of 1–2 mm. A relatively high temperature is associated with the blade contact of the belt, and tends to cause setting in thinner blades.

Figure 2C:
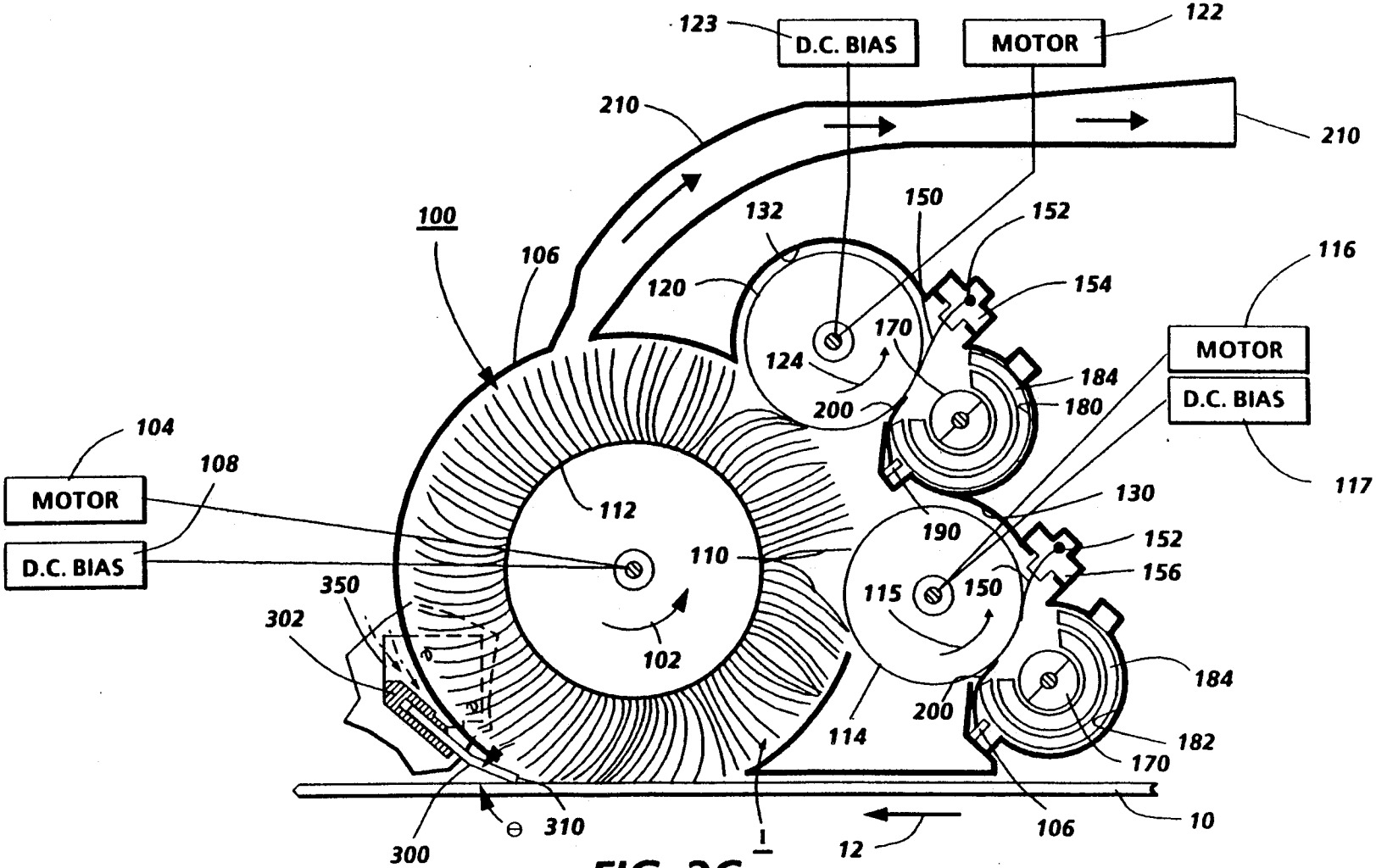
FIG. 2C shows yet another embodiment of a cleaner incorporating the invention.

With reference to FIG. 2C, in a variation on the embodiment of FIG. 2B, cleaning blade 300 and its support member 302 are shown, mounted on the machine frame at inboard and outboard ends via a pair of bracket members 350 (outboard end only shown). Blade 300 is positioned with respect to fibers 110 of cleaning brush 100, so that the area where agglomerates accumulate adjacent blade tip 310 is cleaned by the brush. By supporting the blade on at inboard and outboard ends, and allowing a spacing between blade support member 302, and housing 106, an airflow path is provided past the blade and blade tip for the removal of agglomerates, and to prevent the blade from acting as a sealing member on the cleaning housing, preventing the influx of air therepast.

Figure 3:
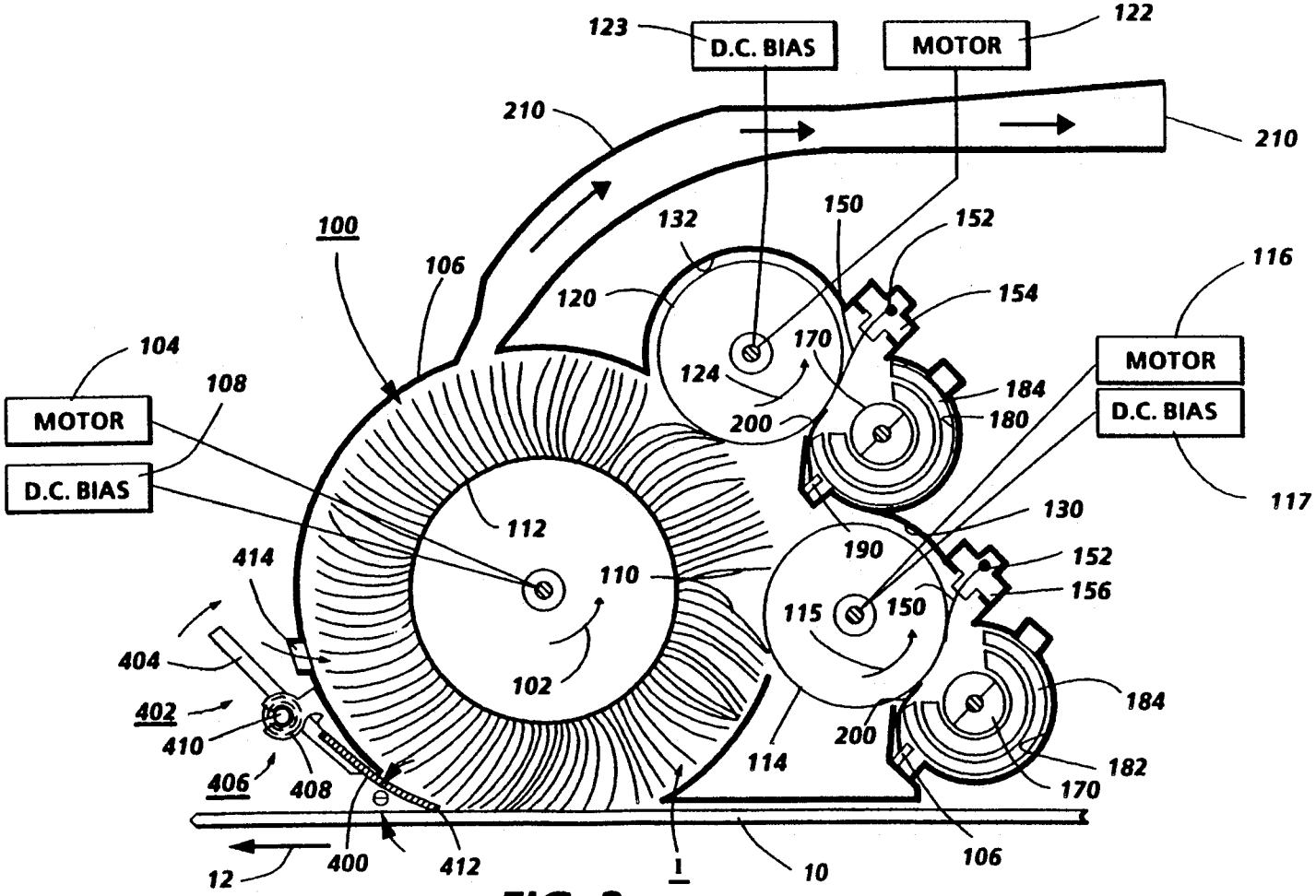

In accordance with another aspect of the invention, another embodiment of the blade holder arrangement is shown in FIG. 3. An agglomerate cleaning blade for the removal of spot causing agglomerates from the photoreceptor adhering thereto after cleaning, is again located slightly downstream (in the process direction) from cleaning brush 100, adjacent and parallel to photoreceptor 10, and transverse to the process direction 12. Agglomerate cleaning blade 400 is clamped into a cleaning position in interference relationship with the photoreceptor 10 in a blade holder 402 adapted to retain the blade in cleaning position. In the embodiment shown, the blade holder 402 acts as a clamp formed with a clamping member 404 and housing 106. Clamping member 404 is pivotably supported on housing 106 with a pivoting knuckle joint 406 formed by complementary seating joint member 408, integrally mounted on housing 106, and pivot joint member 410 on clamping member 404, conveniently located at either end of the clamping member and housing. A torsion spring or other arrangement at pivoting knuckle joint 406 may be used to maintain the clamping engagement position of clamping member 404. In the embodiment, the blade is positioned so that the area where agglomerates are accumulated, and the cleaning edge 412 of the blade are swept by the cleaning brush 100 for the removal of agglomerates therefrom. As before, blade holder 402 supports blade 400 to provide a very low angle of attack with respect to the photoreceptor. The angle of attack Θ (or the angle at the tip 412 of blade 400) is typically in the range of just greater than 0° to approximately 9° with respect to the photoreceptor. Additionally, the load on the blade is selected to be relatively low, preferably in the range of approximately 5–8 gm/cm. It is important that the housing be sufficiently fiducial in it position with respect to the photoreceptor to maintain the angle of attack and load of the blade member.

In this embodiment of FIG. 3, because of the potential for blade member 400 to act as a sealing member on the cleaning housing, preventing the influx of air therepast, it is desirable to provide an opening or series of openings in the cleaning housing to allow the flow of air thereinto. In the embodiment of FIG. 2B, the housing is provided with an opening or series of openings 414 to assure the flow of air into the housing.

Figure 4:
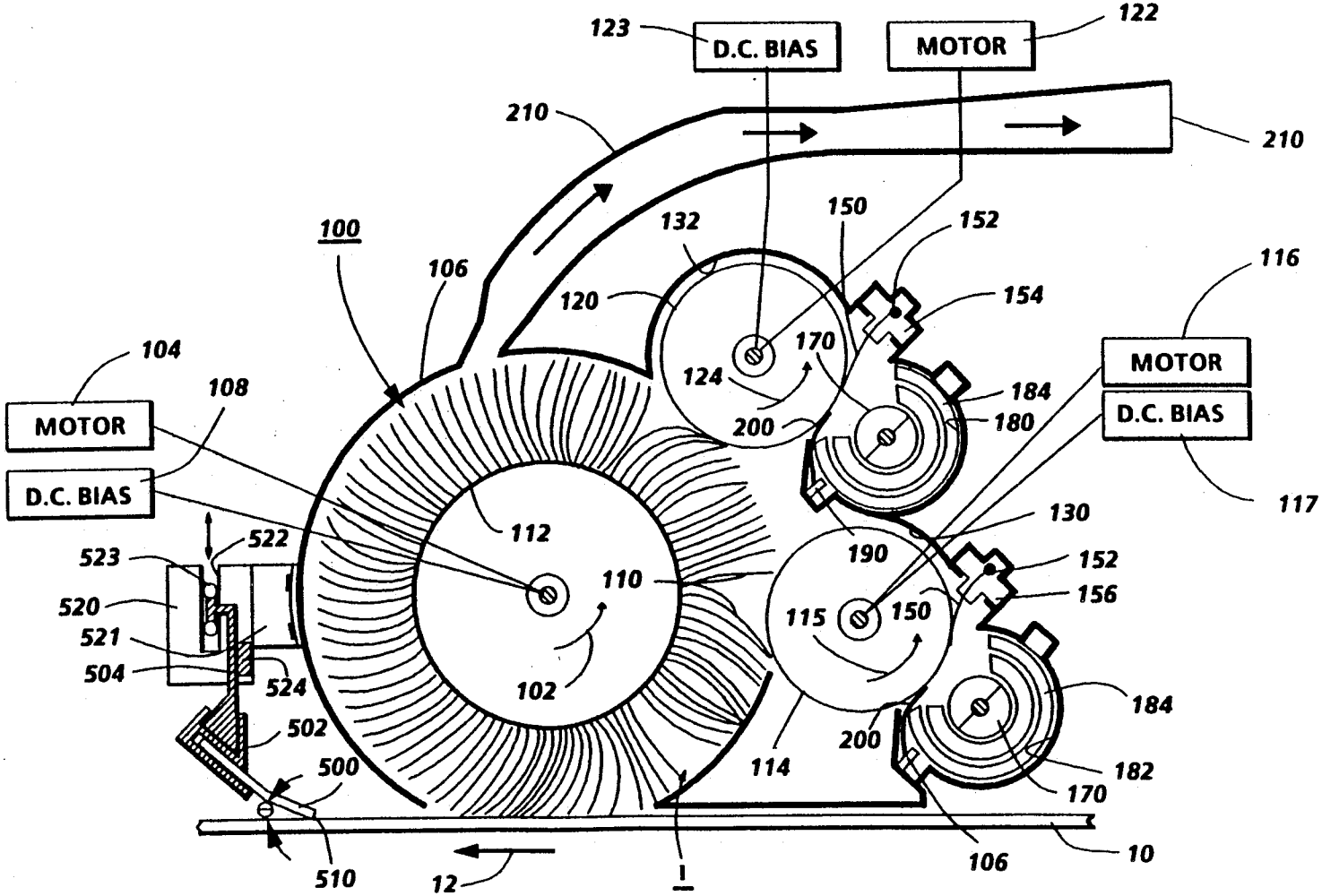

In yet another embodiment of the invention, as shown in FIG. 4, cleaning blade 500 is supported in a slotted blade holder 502 adapted to retain blade in cleaning position. Blade holder 502 is mounted on a blade fixture 304 which is allowed to float so that the load on the blade is the weight of the holder. To allow the blade to float with respect to the photoreceptor a pair of slotted support members 520, (only the rear support member shown) preferably on the cleaning housing via mounting 521 machine frame (not shown) at front and rear sides of photoreceptor 12 provide a slot 522, generally perpendicularly oriented with respect to photoreceptor 10, within which sliders 523 on blade carrier 504 are retained. Sliders 523 are vertically free to move within slot 522 to allow a floating arrangement. A weight 524 is provided on the blade carrier 504 to control the load on the blade. Again, in this configuration it is important that the blade holder be sufficiently fiducial in its position with respect to the photoreceptor to maintain the angle of attack and load of the blade member. Blade holder 502 may be allowed to pivot in a plane parallel to photoreceptor 12, about an axis perpendicular to the photoreceptor, so long as blade 500 is held at the critical angle.

Because the agglomerate cleaning blade is substantially nonfunctional for cleaning residual toner and the amount of agglomerates spot forming particles expected over time is relatively low, perhaps 1 particle per 1000 copies made, there is no particular need to provide a particle collection arrangement associated with an agglomerate cleaning blade, since the amount of particles collected at the blade could be removed periodically during maintenance. Certainly, a particle collection arrangement could be provided. Additionally, it has been found that when blade 300 is located relatively close to brush 100, the air stream through the region adjacent blade 300 caused by moving brush 100 and the vacuum collection arrangement tends to entrain the accumulating particles from the area adjacent the blade, and carry the particles therefrom. This effect is noted when the blade is located at a spacing of about 1 inch from the brush, and closer.

The invention has been described with reference to a preferred embodiment. Obviously modifications will occur to others upon reading and understanding the specification taken together with the drawings. These embodiments are but examples, and various alternatives modifications, variations or improvements may be made by those skilled in the art from this teaching which is intended to be encompassed by the following claims.

We claim:

1. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner and debris from the charge retentive surface, said cleaning means comprising:

a primary cleaner removing the predominant amount of residual toner and debris; and an agglomerate cleaning blade, including a cleaning edge supported at a low angle of attack in engagement with the charge retentive surface at a relatively low load, for shearing release of spot causing agglomerate particles from the charge retentive surface.

2. The apparatus defined in claim 1 wherein the agglomerate cleaning blade is supported in engagement with the charge retentive surface at an angle of attack in the range of just greater than 0° to approximately 9°.

3. The apparatus defined in claim 1 wherein the agglomerate cleaning blade is supported in engagement with the charge retentive surface with a load in the range of approximately 0–10 gm/cm.

4. The apparatus defined in claim 1 wherein the primary cleaner is a rotating brush member, held in cleaning relationship with the charge retentive surface.

5. The apparatus defined in claim 4 wherein said cleaning edge of said agglomerate cleaning blade is supported in close association with said cleaning brush.

6. The apparatus defined in claim 5 wherein said cleaning edge of said agglomerate cleaning blade and the area immediately adjacent thereto, where spot causing agglomerate particles accumulate is contacted and cleaned by said cleaning brush.

7. The apparatus defined in claim 4 wherein said brush member is provided with an air stream detoning arrangement for the removal of residual toner and debris collected by the brush therefrom, wherein toner and debris are entrained in an air stream and directed to an output.

8. The apparatus defined in claim 7 wherein said cleaning edge of said agglomerate cleaning blade is supported in close association with said cleaning brush to allow agglomerate particles accumulating adjacent thereto to be entrained by said air stream and directed to an output.

9. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner from the charge retentive surface, said cleaning means comprising:

a primary cleaning system including a rotary brush cleaner mounted for rotation in cleaning engagement with the photoreceptor within a cleaning housing for the removal of the preponderance of toner from the charge retentive surface;

an air stream detoning arrangement directing a stream of air through the brush and housing to collect toner removed by the brush, said air stream entraining said toner and directing entrained toner to an output; and an agglomerate cleaning blade, including a cleaning edge supported at a low angle of attack in engagement with the charge retentive surface at a relatively low load, for shearing release of spot causing agglomerate particles from the charge retentive surface.

10. The apparatus defined in claim 9 wherein the agglomerate cleaning blade is supported in engagement with the charge retentive surface at an angle of attack in the range of just greater than 0° to approximately 9°.

11. The apparatus defined in claim 9 wherein the agglomerate cleaning blade is supported in engagement with the charge retentive surface with a load of approximately 0–10 gm/cm.

12. The apparatus defined in claim 9 wherein said cleaning edge of said agglomerate cleaning blade is supported in close association with said cleaning brush.

13. The apparatus defined in claim 12 wherein said cleaning edge of said agglomerate cleaning blade and the area immediately adjacent thereto, where spot causing agglomerate particles accumulate after removal from the charge retentive surface, are contacted and cleaned by said cleaning brush.

14. The apparatus defined in claim 12 wherein said cleaning edge of said agglomerate cleaning blade is supported in close association with said cleaning brush to allow agglomerate particles accumulating adjacent thereto to be entrained by said air stream and directed to an output.

15. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner from the charge retentive surface, said cleaning means comprising:

a primary cleaning system including a rotary brush cleaner mounted for rotation in cleaning engagement with the photoreceptor within a cleaning housing for the removal of the preponderance of toner from the charge retentive surface;

an air stream detoning arrangement directing a stream of air through the brush and housing to collect toner removed by the brush, said air stream entraining said toner and directing entrained toner to an output; and an agglomerate cleaning blade, mounted on said cleaning housing, downstream from said brush cleaner including a cleaning edge supported at a low angle of attack and in engagement with the charge retentive surface at a relatively low load, for shearing release of spot causing agglomerate particles from the charge retentive surface.

16. The apparatus defined in claim 15 wherein the agglomerate cleaning blade is supported in engagement with the charge retentive surface at an angle of attack in the range of just greater than 0° to approximately 9°.

17. The apparatus defined in claim 15 wherein the agglomerate cleaning blade is supported in engagement with the charge retentive surface with a load of approximately 0–10 gm/cm.

18. The apparatus defined in claim 15 wherein said cleaning edge of said agglomerate cleaning blade is supported in close association with said cleaning brush.

19. The apparatus defined in claim 18 wherein said cleaning edge of said agglomerate cleaning blade and the area immediately adjacent thereto, where spot causing agglomerate particles accumulate after release from the charge retentive surface, are contacted and cleaned by said cleaning brush.

20. The apparatus defined in claim 18 wherein said cleaning edge of said agglomerate cleaning blade and the area immediately adjacent thereto, where spot causing agglomerate particles accumulate after release from the charge retentive surface, are contacted and cleaned by said cleaning brush.

21. The apparatus defined in claim 15 wherein said cleaning edge of said agglomerate cleaning blade is supported in close association with said cleaning brush and said released agglomerate particles accumulating adjacent thereto are entrained by said air stream and directed to an output.

22. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner from the charge retentive surface, said cleaning means comprising:

a primary cleaning system including a rotary brush cleaner mounted for rotation in cleaning engagement with the photoreceptor within a cleaning housing for the removal of the preponderance of toner from the charge retentive surface;

means for removing collected toner from the rotary brush cleaner; and an agglomerate cleaning blade, floatingly mounted downstream from said brush cleaner with a predetermined relatively low load, including a cleaning edge supported at a low angle of attack in engagement with the charge retentive surface for shearing release of spot causing agglomerate particles from the charge retentive surface.

23. The apparatus defined in claim 22 wherein the agglomerate cleaning blade is supported in engagement with the charge retentive surface at an angle of attack in the range of just greater than 0° to approximately 9°.

24. The apparatus defined in claim 22 wherein the agglomerate cleaning blade is supported in engagement with the charge retentive surface with a load of approximately 0–10 gm/cm.

25. The apparatus defined in claim 22 wherein said cleaning edge of said agglomerate cleaning blade is supported in close association with said cleaning brush.

26. The apparatus defined in claim 22 wherein the agglomerate cleaning blade is allowed free movement in a direction perpendicular to a plane defined by the charge retentive surface.

27. Reproduction apparatus including a charge retentive surface; image forming means for forming a latent image on the charge retentive surface; developing means for developing the latent image with toner; transfer means for transferring the developed toner image from the charge retentive surface to a support surface; and cleaning means for removing residual toner from the charge retentive surface, said cleaning means comprising:

a primary cleaning system including a rotary brush cleaner mounted for rotation in cleaning engagement with the photoreceptor within a cleaning housing for the removal of the preponderance of toner from the charge retentive surface;

means for removing collected toner from the rotary brush cleaner; and an agglomerate cleaning blade, mounted on said said brush cleaner housing and supported in engagement with said charge retentive surface with a predetermined relatively low load, including a cleaning edge supported at a low angle of attack with the charge retentive surface for shearing release of spot causing agglomerate particles from the charge retentive surface.

28. The apparatus defined in claim 27 wherein the agglomerate cleaning blade is supported in engagement with the charge retentive surface at an angle of attack in the range of just greater than 0° to approximately 9°.

29. The apparatus defined in claim 27 wherein the agglomerate cleaning blade is supported in engagement with the charge retentive surface with a load of approximately 0–10 gm/cm.

30. The apparatus defined in claim 27 wherein said cleaning edge of said agglomerate cleaning blade is supported in close association with said cleaning brush.

* * * * *